United States Patent [19]

Soeda et al.

[11] 4,143,605

[45] Mar. 13, 1979

[54] MOTOR DRIVEN SEWING MACHINE

[75] Inventors: Katsuji Soeda; Fumio Sakuma; Mitsuhiro Ooyama, all of Sukagawa, Japan

[73] Assignee: Yamamoto Electric Industrial Co., Ltd., Fukushima, Japan

[21] Appl. No.: 823,104

[22] Filed: Aug. 8, 1977

[30] Foreign Application Priority Data

Aug. 9, 1976 [JP] Japan ..... 51-94589

[51] Int. Cl.[2] ..... D05B 3/02

[52] U.S. Cl. ..... 112/158 E; 307/106

[58] Field of Search ..... 112/158 E, 275, 277, 112/121.11, 220; 307/106; 335/207

[56] References Cited

U.S. PATENT DOCUMENTS

| | | | |
|---|---|---|---|
| 3,114,020 | 12/1963 | Hall | 335/207 |
| 3,686,507 | 8/1972 | Krutz et al. | 307/106 |
| 3,815,531 | 6/1974 | Wurst et al. | 112/275 X |
| 3,855,956 | 12/1974 | Wurst | 112/158 E |

*Primary Examiner*—Peter Nerbun

*Attorney, Agent, or Firm*—Armstrong, Nikaido, Marmelstein & Kubovcik

[57] ABSTRACT

A motor driven sewing machine comprises pulse generator means for generating a first pulse associated with the first predetermined angular position and a second pulse associated with the second predetermined angular position of the main-shaft of the machine, and state-alternating means for alternatively changing its states between first and second states in response to the first and second pulses. The needle position and cloth feed are controlled in accordance with the states of the state-alternating means.

6 Claims, 4 Drawing Figures

MOTOR DRIVEN SEWING MACHINE

BACKGROUND OF THE INVENTION

1. Field of the Invention

This invention relates to an improvement in a motor driven sewing machine comprising an electrical signal generator for generating an electrical signal in response to a predetermined rotational angular position of the main-shaft of the sewing machine.

2. Description of the Prior Art

A motor driven sewing machine was recently developed which is provided with an electrical signal generator for generating an electrical signal in response to a predetermined rotational angular position of the main-shaft of the sewing machine in order to control the needle position and the cloth feed in response to the electrical signal. Examples of such a sewing machine are disclosed in the U.S. Patent Application Ser. No. 364,835 entitled "Sewing Machine Equipped with Pulse Generator", filed May 29, 1973 by John W. Wurst and James E. O'Brien and issued June 11, 1974 as the U.S. Pat. No. 3,815,531 and assigned to The Singer Company; and the U.S. Patent Application Ser. No. 376,780 entitled "Sewing Machines Stitch Pattern Generation Form Stitch Data Stored in Static Memory", filed July 5, 1973 by John W. Wurst and issued Dec. 24, 1974 as U.S. Pat. No. 3,855,956 and assigned to The Singer Company.

Such an electrical signal generator, however, in order to obtain separately a first electrical signal associated with the first angular position of the main-shaft and a second electrical signal associated with the second angular position thereof, must be provided with two angular position detectors, i.e., a first angular position detector for detecting the first angular position of the main spindle and producing a first signal and a second angular position detector for detecting the second angular position of the main-shaft and producing a second signal, resulting in a complicated construction and high cost.

The object of the present invention is to obviate the above-mentioned disadvantages.

DESCRIPTION OF THE PREFERRED EMBODIMENTS

Figure 1:
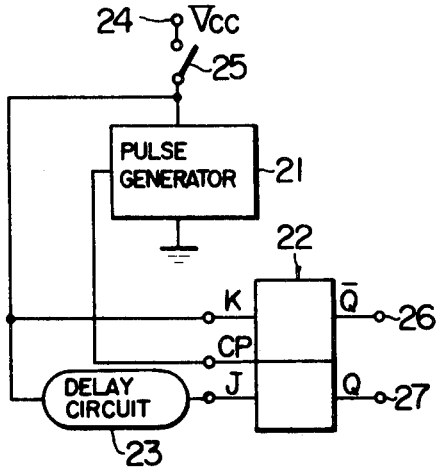
FIG. 1 is a wiring diagram showing an embodiment of the electrical signal generator according to the present invention.

A wiring diagram of an embodiment of the electrical signal generator according to the present invention is shown in FIG. 1. A pulse generator 21 for generating pulses associated with predetermined angular positions of the main-shaft of the sewing machine is connected via a single-pole single-throw switch 25 to a terminal 24 of a DC power supply (not shown) impressed with a source voltage Vcc. The output of the pulse generator 21 is connected to a state-alternating means, preferably a CP input of a JK flip-flop 22. One of the J and K inputs, for instance, the K input of the JK flip-flop 22 is connected to the terminal 24 through a switch 25, in which case the J input thereof is connected to, say, a switch 25 through a delay circuit 23 such as a CR circuit. Assume now that the switch 25 is closed to connect the DC power supply to the JK flip-flop. Since the J input is impressed with the DC voltage Vcc through the delay circuit 23, the K input reaches Vcc level earlier than J input, with the result that the output $\overline{Q}$ is held at high level and the output Q at low level. Next, upon application of the output pulse of the pulse generator 21 to the CP input, the outputs Q and $\overline{Q}$ are reversed in state. This reversal is repeated in response to each subsequent application of a pulse.

Figure 2:
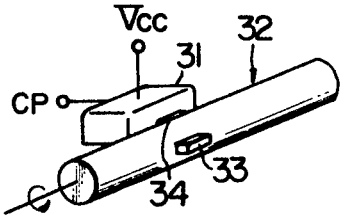
FIGS. 2 and 3 show embodiments of the pulse generator circuit used in the electrical signal generator according to the present invention.
Figure 3:
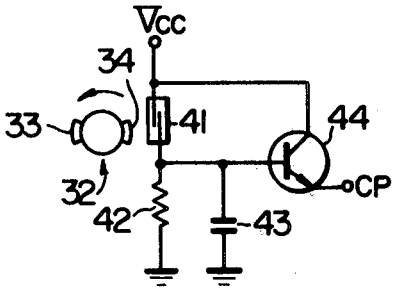

Embodiments of the pulse generator used in the electrical signal generator according to the present invention are shown in FIGS. 2 and 3. In FIG. 2, a permanent magnet 33 is mounted on the periphery surface of the main-shaft 32 operatively interlocked with a needle bar and a feed mechanism. In proximity to the main-shaft, there is provided a Hall effect element or other angular position detector for generating a pulse associated with a predetermined angular position of the main-shaft in response to the detection of the maximum magnetic field of the permanent magnet 33, i.e., detection of the closest approach of the permanent magnet 33. The Hall effect element 31 produces an output pulse by detecting the maximum magnetic field of the magnet 33 each time of approach thereof to the Hall effect element 31 with the rotation of the main-shaft. The magnet 33 and the Hall effect element 31 are located in such relative positions that when the main-shaft reaches a predetermined angular position such as to locate the operatively interlocked needle bar at a predetermined position on the way of moving up toward an upper dead point from the cloth, the magnet 33 and the Hall effect element 31 are opposed to each other to permit the Hall effect element 31 to produce an output pulse. According to this embodiment, another permanent magnet 34 may be located on the periphery surface of the main-shaft substantially opposed to the magnet 33 in such a relation that when the needle bar reaches a predetermined position on the way down from the upper supporting point to the cloth, the magnet 34 and the Hall effect element 31 are opposed to each other to produce an output pulse. As a result, after the closure of the switch 25 (assuming that the needle bar is positioned at the upper supporting point at that time), when the needle bar moves from the upper dead point toward the cloth with the rotation of the main-shaft 32, the magnet 34 approaches the Hall effect element 31 so that the Hall effect element 31 produces a first pulse, thereby reversing the outputs Q and $\overline{Q}$ of the flip-flop 22 to high and low levels respectively. Next, during the time when the needle bar reaches the predetermined position on the way from the cloth toward the upper dead point, a second pulse is generated so that the outputs Q and $\overline{Q}$ are reversed again in state.

Another embodiment of the pulse generator is illustrated in FIG. 3. This embodiment includes an angular position detector including a reed switch 41 and an NPN transistor 44. The reed switch 41 is adapted to close with the approach thereto of the magnet 33 or 34 with the rotation of the main-shaft 32. The reed switch 41 and the magnets 33 and 34 are in the same relative positions as the Hall effect element 31 and the magnets 33 and 34 in the embodiment of FIG. 2. An end of the reed switch 41 is connected to a DC power supply (not shown) and impressed with the source voltage Vcc, while the other end thereof is connected to the base of the transistor 44 on the one hand, and grounded through a parallel circuit including a resistor 42 and a capacitor 43 on the other hand. Each time the reed switch 41 is closed, a pulse voltage of Vcc level is applied to the base electrode of the transistor 44, so that the transistor 44 is turned on to supply a pulse to the CP input. The resistor 42 and the capacitor 43 make up a differentiator/integrator circuit. The resistor 42 and the capacitor 43 prevents misconduction of the transistor 44 due to a sharp pulse generated by a misactuation of the reed switch 41.

Figure 4:
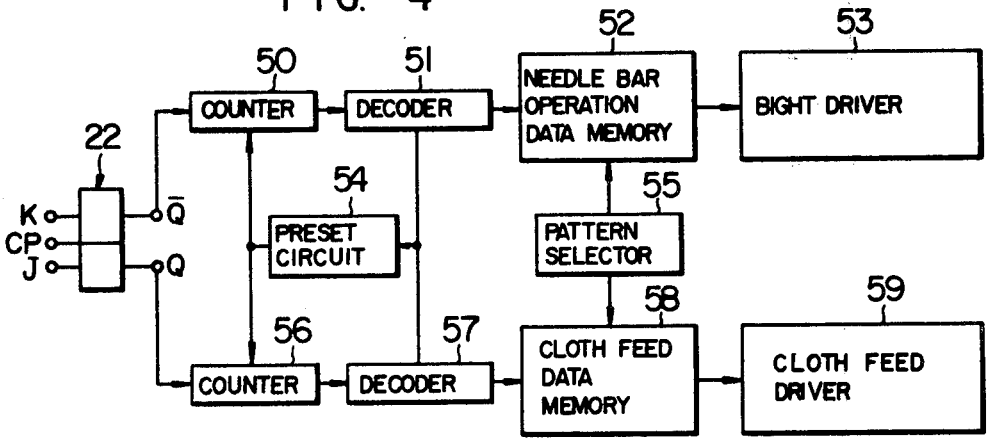
FIG. 4 is a block diagram showing an electronic sewing machine control device using the electrical signal generator according to the invention.

A block diagram of the electronic sewing machine control device using the electrical signal generator according to the present invention is shown in FIG. 4. First, when the JK flip-flop 22 is connected to a DC supply, the output Q becomes high and the output $\overline{Q}$ low in level, so that the counter 50 counts "1". The binary output of the counter 50 is decoded by the decoder 51. The decimal output "1" of the decoder 51 addresses and reads predetermined bight information in the needle bar operation data memory 52 selected by the pattern selector 55. Thus the bight driver 53 is controlled to position the needle bar at a predetermined bight position. At this time, the needle bar is positioned at or in the vicinity of the upper supporting point. Next when the needle bar begins to move down from the upper dead point to the cloth with the rotation of the main-shaft 32 and approaches the pregiven position, the CP input of the flip-flop 22 is impressed with the first pulse thereby to reverse the states of the outputs Q and $\overline{Q}$. As a result, the outputs $\overline{Q}$ and Q become low and high in level respectively. The counter 56 counts "1". The decimal output "1" of the decoder 57 addresses and reads the predetermined feed operation data of the feed data memory 58 selected by the pattern selector 55, so that the feed driver 59 is controlled so as to feed the cloth for a predetermined length. Further, when the needle bar comes to the pregiven position toward the upper dead point from the cloth with the rotation of the shaft 32, the CP input is impressed with a second pulse. The outputs Q and Q become high and low in level respectively, thus moving the needle bar to the next bight position. In this way, a predetermined pattern is stitched. When the decimal output of the decoder 51 reaches a predetermined number designated by the preset circuit 54, the counter 50 is cleared thereby to resume a similar stitching operation. The needle bar operation data memory 52 and the feed data memory 59 are preferably composed of flip-flop circuits.

It will be understood from the foregoing description that according to the electrical signal generator according to the present invention, signals associated with two angular positions of the main-shaft, i.e., a needle bar position control signal and a feed operation control signal are obtained separately by means of a single angular position detector, leading to a configuration simple and very low in cost.

We claim:

1. A motor driven sewing machine comprising:

means for alternately generating a first pulse associated with a predetermined first angular position of the main-shaft of said sewing machine and a second pulse associated with a second predetermined angular position of said main-shaft of said sewing machine;

means for alternately changing states between a first and second state in response to said first and second pulses and separately producing a first signal representing said first state and a second signal representing said second state;

a first control means for controlling the needle position in accordance with said first signal; and a second control means for controlling the cloth feed in accordance with said second signal.

2. A motor driven sewing machine according to claim 1, in which said state-alternating means includes a JK flip-flop for alternating its state between said first and second states in response to said first and second pulses.

3. A motor driven sewing machine according to claim 2, in which said state-alternating means further includes a delay circuit, said JK flip-flop including a J input, a K input and a CP input, one of said J and K inputs being connected to a DC power supply, the other of said J and K inputs being connected via said delay circuit to said DC power supply, and said CP input being impressed with said first and second pulses.

4. A motor driven sewing machine according to claim 3, in which said pulse generator means includes a first piece of permanent magnet mounted at a first position associated with said first angular position on the circumferential surface of said main-shaft, a second piece of permanent magnet mounted at a second position associated with said second angular position on said circumferential surface of said main-shaft, and angular position detector means for detecting the closest approach of said first and second pieces of permanent magnet thereto and generating said first and second pulses respectively in response to the detections.

5. A motor driven sewing machine according to claim 4, in which said angular position detector means is a Hall effect element.

6. A motor driven sewing machine according to claim 5, in which said angular position detector means includes a reed switch adapted to close upon detection of the closest approach of each of said first and second pieces of permanent magnet thereto, and a switching element with a controlled electrode connected to said reed switch, said switching element producing said pulses in response to the closure of said reed switch.

* * * * *